US007607900B2

(12) United States Patent
Ichikawa et al.

(10) Patent No.: US 7,607,900 B2
(45) Date of Patent: Oct. 27, 2009

(54) MULTI-CYLINDER RECIPROCATING COMPRESSOR

(75) Inventors: Yoshinobu Ichikawa, Isesaki (JP); Jeong-Il Park, West Lafayette, IN (US); Douglas E. Adams, West Lafayette, IN (US)

(73) Assignees: Purdue Research Foundation, West Lafayeete, IN (US); Sanden Corporation, Isesaki-shi, Gunma (JP)

( * ) Notice: Subject to any disclaimer, the term of this patent is extended or adjusted under 35 U.S.C. 154(b) by 509 days.

(21) Appl. No.: 10/937,892

(22) Filed: Sep. 10, 2004

(65) Prior Publication Data

US 2006/0056985 A1 Mar. 16, 2006

(51) Int. Cl.
*F04B 39/00* (2006.01)
*F04B 27/08* (2006.01)

(52) U.S. Cl. ..... 417/540; 417/312; 417/269

(58) Field of Classification Search ..... 417/53, 417/222, 269, 437, 312, 313, 540, 222.2; 92/71, 72; 181/403, 277, 279
See application file for complete search history.

(56) References Cited

U.S. PATENT DOCUMENTS

| | | | | |
|---|---|---|---|---|
| 3,577,891 | A | 5/1971 | Nemoto et al. | |
| 3,807,907 | A * | 4/1974 | Gannaway | 417/415 |
| 4,790,727 | A * | 12/1988 | Steele | 417/269 |
| 4,930,995 | A * | 6/1990 | Suzuki et al. | 417/312 |
| 4,936,754 | A * | 6/1990 | Suzuki et al. | 417/269 |
| 5,702,236 | A * | 12/1997 | Ikeda | 417/269 |
| 6,045,342 | A * | 4/2000 | Kimura | 417/540 |
| 6,068,453 | A | 5/2000 | Ahn et al. | |
| 6,231,315 | B1 * | 5/2001 | Ikeda et al. | 417/269 |
| 6,293,763 | B1 | 9/2001 | Yokomachi et al. | |
| 6,293,768 | B1 * | 9/2001 | Shintoku et al. | 417/312 |
| 6,390,786 | B1 * | 5/2002 | Gennami et al. | 417/269 |
| 6,705,843 | B1 * | 3/2004 | Kuo | 417/312 |
| 7,172,393 | B2 | 2/2007 | Adams et al. | |
| 2002/0026871 | A1 * | 3/2002 | Hashimoto et al. | 92/71 |
| 2004/0091370 | A1 * | 5/2004 | Yoon et al. | 417/269 |

FOREIGN PATENT DOCUMENTS

| | | | |
|---|---|---|---|
| DE | 19945145 | A1 | 3/2000 |
| EP | 1041285 | A2 | 10/2000 |
| JP | 51068005 | * | 5/1976 |

(Continued)

OTHER PUBLICATIONS

European Search Report (3 pages) of counterpart European patent application.

(Continued)

*Primary Examiner*—Devon C Kramer
*Assistant Examiner*—Leonard J Weinstein
(74) *Attorney, Agent, or Firm*—Baker Botts L.L.P.

(57) ABSTRACT

A multi-cylinder reciprocating compressor includes a cylinder block provided with a plurality of pistons each for performing a working fluid suction stroke and a working fluid compression/discharge stroke, and a cylinder head arranged adjacent to the cylinder block. The cylinder head defines therein a discharge chamber and an annular suction chamber surrounding the discharge chamber and has a plurality of cross walls arranged at intervals in a circumferential direction thereof. The cross walls reduce the cross-sectional flow area of the suction chamber.

6 Claims, 4 Drawing Sheets

FOREIGN PATENT DOCUMENTS

| | | | | |
|---|---|---|---|---|
| JP | 03056887 | | * | 5/1991 |
| JP | 06147116 | A | * | 5/1994 |
| JP | 07233783 | A | * | 9/1995 |
| JP | 2002250279 | A | | 9/2002 |

OTHER PUBLICATIONS

Japan Patent Office; Notification of Reasons for Refusal in Japanese Patent Application No. 2005-253897 (counterpart to the above-captioned U.S. Patent Application) mailed Mar. 18, 2009.

* cited by examiner

MULTI-CYLINDER RECIPROCATING COMPRESSOR

BACKGROUND OF THE INVENTION

1. Field of the Invention

The present invention relates to a multi-cylinder reciprocating compressor, and more particularly, to a multi-cylinder reciprocating compressor suited for use in an automotive air conditioning system.

2. Description of the Related Art

An air conditioning system for a motor vehicle comprises a refrigeration circuit which includes, for example, a multi-cylinder reciprocating compressor. The reciprocating compressor is disposed between an evaporator and a condenser in the refrigeration circuit and has a plurality of pistons fitted in a cylinder block thereof. The pistons are reciprocated in turn by rotation of a swash plate. As the pistons reciprocate, the reciprocating compressor sucks in a refrigerant, compresses the refrigerant into a high-pressure state, and discharges the high-pressure refrigerant to the condenser.

More specifically, the reciprocating compressor has a refrigerant suction chamber and a refrigerant discharge chamber. The suction and discharge chambers are defined inside the cylinder head of the compressor. As is clear from U.S. Pat. No. 6,293,763, the discharge chamber is located at the center of the cylinder head and connected to the condenser through a discharge port. The suction chamber is an annular chamber surrounding the discharge chamber and is connected to the evaporator through a suction port. During the suction stroke of a piston, a compression chamber associated with the piston is connected to the suction chamber through a suction valve, so that the refrigerant is introduced into the compression chamber from the suction chamber. In the last stage of the subsequent compression/discharge stroke of the piston, the compression chamber is connected to the discharge chamber through a discharge valve, and therefore, the high-pressure refrigerant is discharged from the compression chamber to the discharge chamber.

In the multi-cylinder reciprocating compressor described above, the pistons, that is, the compression chambers, are arranged at intervals in the circumferential direction of the swash plate. Accordingly, as the swash plate rotates, the refrigerant in the suction chamber is introduced sequentially into the compression chambers. When the refrigerant is introduced into each compression chamber, the pressure in the suction chamber temporarily drops, and the pressure drop allows the refrigerant to flow into the suction chamber through the suction port, so that the pressure in the suction chamber rises.

Thus, each time the refrigerant is introduced into each compression chamber, the pressure in the suction chamber rises and falls. Since the suction chamber has an annular shape as mentioned above, such pressure variation is propagated in the circumferential direction of the suction chamber, causing pressure pulsation in the suction chamber.

In some cases the pressure pulsation is notably amplified in a specific frequency range which depends on the size of the suction chamber, that is, the circumferential length of the suction chamber. Such amplified pressure pulsation not only causes vibrations of the components of the refrigeration circuit, such as a suction pipe connected to the suction port of the suction chamber and the evaporator connected to the suction pipe, but also increases noise from the components. Specifically, in the case of compressors of sizes used in automotive air conditioning systems, the pressure pulsation is liable to be amplified especially in the frequency range around 500 Hz.

To reduce the vibrations and noise, a muffler may be inserted in the suction pipe or an expansion chamber communicating with the suction chamber may be formed in the cylinder head. However, the use of the muffler leads to increase in the number of components of the refrigeration circuit, and also it is not easy to secure space for the muffler in the engine compartment of the vehicle. Forming the expansion chamber, on the other hand, leads to increased size of the cylinder head and thus of the compressor, also making the arrangement of the compressor in the engine compartment difficult.

SUMMARY OF THE INVENTION

An object of the present invention is to provide a multi-cylinder reciprocating compressor which does not require an additional external component for suppressing pressure pulsation in the suction chamber and at the same time does not entail increase in size of the cylinder head.

The object is achieved by a multi-cylinder reciprocating compressor of the present invention. The compressor comprises: a cylinder block having a plurality of cylinder bores; a plurality of pistons received in the respective cylinder bores, for defining compression chambers in the respective cylinder bores; a cylinder head arranged adjacent to the cylinder block and defining therein a suction chamber and a discharge chamber both capable of communicating with the compression chambers, the suction chamber having an annular shape surrounding the discharge chamber and having a suction port for introducing working fluid into the suction chamber; a drive mechanism for sequentially reciprocating the pistons, to perform an introduction process for introducing the working fluid into each of the compression chambers from the suction chamber and a compression/discharge process for compressing the working fluid introduced into each compression chamber and discharging the compressed working fluid from the compression chamber to the discharge chamber; and a plurality of throat elements located in the suction chamber, for reducing cross-sectional flow area of the suction chamber at a plurality of positions as viewed in a circumferential direction of the cylinder head.

With this compressor, when pressure pulsation produced in the suction chamber during operation of the compressor is propagated in the circumferential direction of the cylinder head, the propagation of the pressure pulsation is partially obstructed by the throat elements, thereby restraining the pressure pulsation from being amplified in a specific frequency range.

Thus, vibrations and noise attributable to the pressure pulsation in the suction chamber can be reduced without the need to use additional means, such as a muffler arranged externally to the compressor or an expansion chamber formed in the cylinder head in communication with the suction chamber.

Also, the cross-sectional flow area of the suction chamber is only partly reduced by the throat elements, and therefore, the suction loss of the working fluid sucked into the suction chamber does not rise to an undesirably high level.

Specifically, each of the throat elements reduces the cross-sectional flow area of the suction chamber in a depth direction thereof along an axial direction of the cylinder head or in a width direction of the suction chamber along a radial direction of the cylinder head.

More specifically, the cylinder head includes an annular partition wall separating the suction chamber and the discharge chamber from each other. Each of the throat elements is a cross wall protruding from an inner end face of the cylinder head toward the cylinder block and extending in the radial direction of the cylinder head between the partition wall and an inner peripheral surface of the cylinder head, or a cross wall protruding from the cylinder block toward the inner end face of the cylinder head and extending in the radial direction of the cylinder head between the partition wall and the inner peripheral surface of the cylinder head.

Further, each of the throat elements has a height along the axial direction of the cylinder head and a thickness along the circumferential direction of the cylinder head. Preferably, the height and thickness of each throat element are each approximately half the depth of the suction chamber.

Throat elements may be protuberances protruding from the partition wall and the inner peripheral surface of the cylinder head in the radial direction of the cylinder head, respectively. Preferably, in this case, a region of the suction chamber located between the protuberances as viewed in the circumferential direction of the cylinder head forms a passage with a nearly rectangular parallelepipedic shape.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirits and scope of the invention will become apparent to those skilled in the art from this detailed description.

BRIEF DESCRIPTION OF THE DRAWINGS

The present invention will become more fully understood from the detailed description given hereinafter and the accompanying drawings which are given by way of illustration only, and thus, are not limitative of the present invention, and wherein.

DETAILED DESCRIPTION OF THE PREFERRED EMBODIMENT

Figure 1:
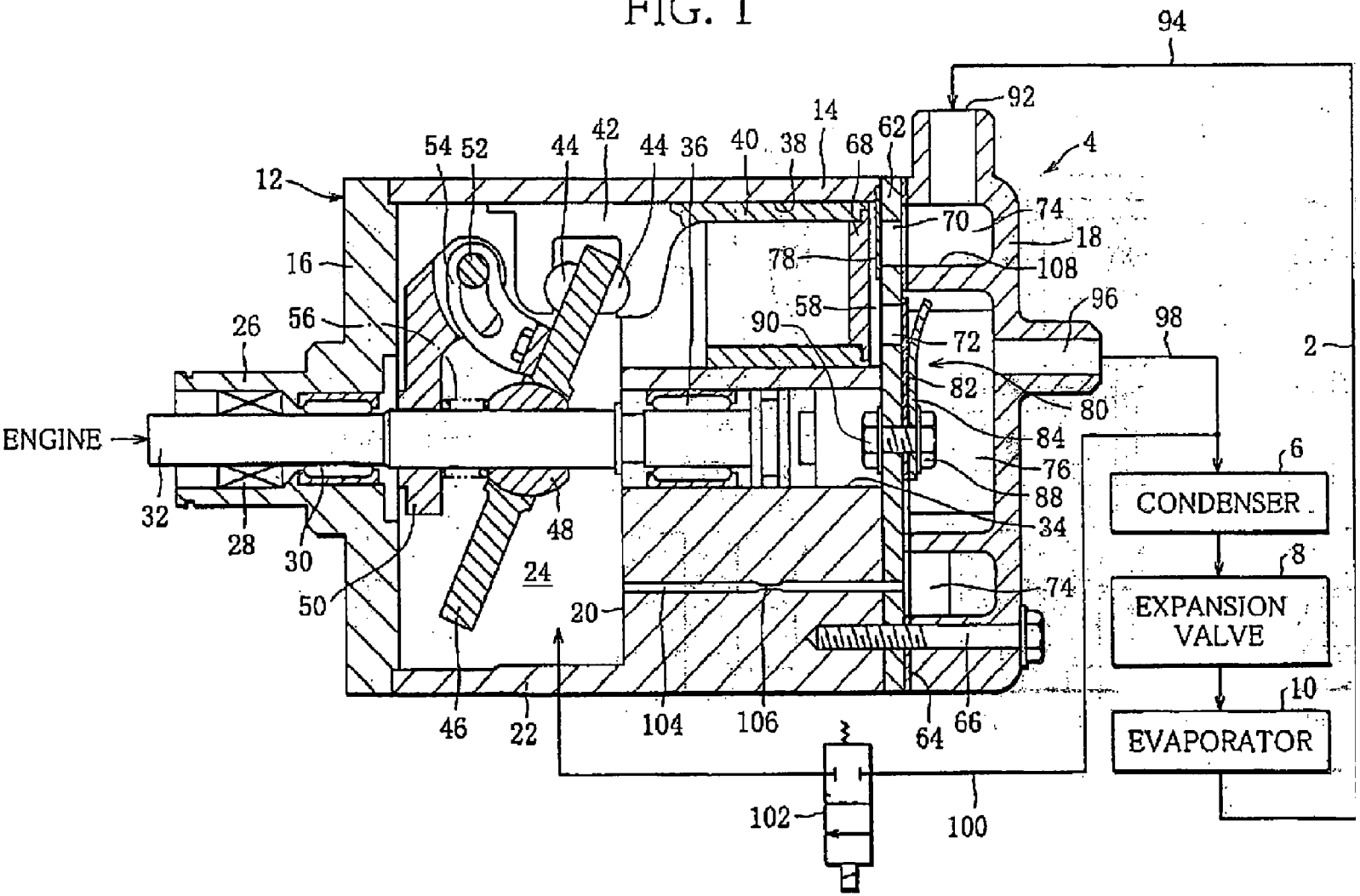
FIG. 1 is a sectional view of a multi-cylinder reciprocating compressor according to one embodiment of the present invention.

An air conditioning system for a motor vehicle comprises a refrigeration circuit shown in FIG. 1, and the refrigeration circuit has a refrigerant path 2. In the refrigerant path 2 are arranged a multi-cylinder reciprocating compressor 4, a condenser 6, an expansion valve 8 and an evaporator 10 in the order mentioned.

The compressor 4 includes a cylindrical housing 12. The housing 12 has a cylinder block 14, and an end plate 16 and a cylinder head 18 arranged on opposite sides of the cylinder block 14, respectively.

The cylinder block 14 has a cylindrical sleeve 22 extending from one end face 20 thereof toward the end plate 16 and having a distal end closed with the end plate 16. The sleeve 22 and the end plate 16 define a crank chamber 24 in cooperation with the end face 20 of the cylinder block 14.

The end plate 16 has a boss 26 at the center thereof, and the boss 26 rotatably supports a drive shaft 32 through a seal 28 and a bearing 30. One end of the drive shaft 32 projects from the boss 26 to outside of the housing 12 for receiving driving force directly from the engine of the vehicle or indirectly through an electromagnetic clutch (not shown). Accordingly, the drive shaft 32 is rotated in one direction by the engine.

The drive shaft 32 extends through the crank chamber 24 and has the other end inserted into a center bore 34 of the cylinder block 14. The center bore 34 is in alignment with the axis of the cylinder block 14 and penetrates through the cylinder block 14 in the axial direction thereof. A bearing 36 is fitted in the center bore 34 and rotatably supports the other end of the drive shaft 32.

Also, the cylinder block 14 has a plurality of cylinder bores 38 formed therein and extending through the cylinder block 14 in the axial direction thereof FIG. 1 shows only one cylinder bore 38.

A piston 40 is fitted into each cylinder bore 38 and has one end projecting into the crank chamber 24. The one end of the piston 40 is formed as a tail 42 provided with a pair of shoes 44.

A circular swash plate 46 is arranged in the crank chamber 24. The swash plate 46 has an outer peripheral edge slidably held between the paired shoes 44 of each piston 40 and is coupled to the drive shaft 32 through a coupling 48. The coupling 48 is slidably fitted on the drive shaft 32 so as to couple the drive shaft 32 and the swash plate 46 together with respect to the rotating direction of the drive shaft 32 but to allow the swash plate 46 to be tilted so that an inclination angle between the swash plate 46 and the axis of the drive shaft 32 may be variable.

Further, a rotor 50 is arranged in the crank chamber 24 at a location between the end plate 16 and the swash plate 46. The rotor 50 is mounted on the drive shaft 32 for rotation together therewith. The rotor 50 and the swash plate 46 are coupled together by a pin 52 and a link 54 which serve to guide the tilting of the swash plate 46.

A compression coil spring 56 is interposed between the rotor 50 and the coupling 48 and pushes the coupling 48 toward the cylinder block 14.

When the swash plate 46 is rotated together with the drive shaft 32, rotation of the swash plate 46 is converted to reciprocating motion of each piston 40 of which the reciprocating stroke is determined by the inclination angle of the swash plate 46.

The reciprocating motion of the piston 40 increases and decreases the volume of a compression chamber 58 defined inside the cylinder bore 38, whereby a refrigerant suction stroke and a refrigerant compression/discharge stroke are carried out.

More specifically, a valve plate 62 and a gasket 64 are interposed between the other end face of the cylinder block 14 and the cylinder head 18, as clearly shown in FIG. 1. The cylinder block 14, the valve plate 62, the gasket 64 and the cylinder head 18 are coupled together by connecting bolts 66.

The compression chamber 58 is defined inside the cylinder bore 38 and between the other end of the piston 40, that is, a piston head 68, and the valve plate 62. The valve plate 62 has suction holes 70 and discharge holes 72 which are associated with the respective cylinder bores 38 and arranged such that the suction holes 70 are located outside of the discharge holes 72 as viewed in the radial direction of the valve plate 62.

The cylinder head 18, on the other hand, has a suction chamber 74 and a discharge chamber 76 defined therein. As is clear from FIG. 1, the discharge chamber 76 is located at the center of the cylinder head 18, and the suction chamber 74 is an annular chamber surrounding the discharge chamber 76.

Each suction hole 70 is opened and closed by a suction valve 78 having a reed-like valve element arranged on one surface of the valve plate 62 on the same side as the compression chamber 58. The discharge holes 72 are each opened and closed by a discharge valve 80 which has a reed-like valve element 82 arranged on the other surface of the valve plate 62 on the same side as the discharge chamber 76 and an arcuate valve retainer 84. The valve element 82 and the valve retainer 84 are attached to the valve plate 62 by a fastening bolt 88 and a nut 90.

The cylinder head 18 also has a suction port 92. The suction port 92 communicates with the suction chamber 74 and is also connected to the aforementioned refrigerant path 2, that is, a suction pipe 94 connecting between the compressor 4 and the evaporator 10.

Further, the cylinder head 18 has a discharge port 96. The discharge port 96 communicates with the discharge chamber 76 and is also connected to the refrigerant path 2, that is, a delivery pipe 98 connecting between the compressor 4 and the condenser 6.

The compressor 4 has a passage 100 connecting between the discharge chamber 76 and the crank chamber 24, and a solenoid valve 102 is inserted in the connecting passage 100. In FIG. 1, the connecting passage 100 extends outside the housing 12 of the compressor 4 but may be formed through the cylinder block 14.

Further, a communicating passage 104 connecting the suction chamber 74 and the crank chamber 24 to each other is formed through the cylinder block 14, and an orifice 106 is arranged in the communicating passage 104.

Figure 2:
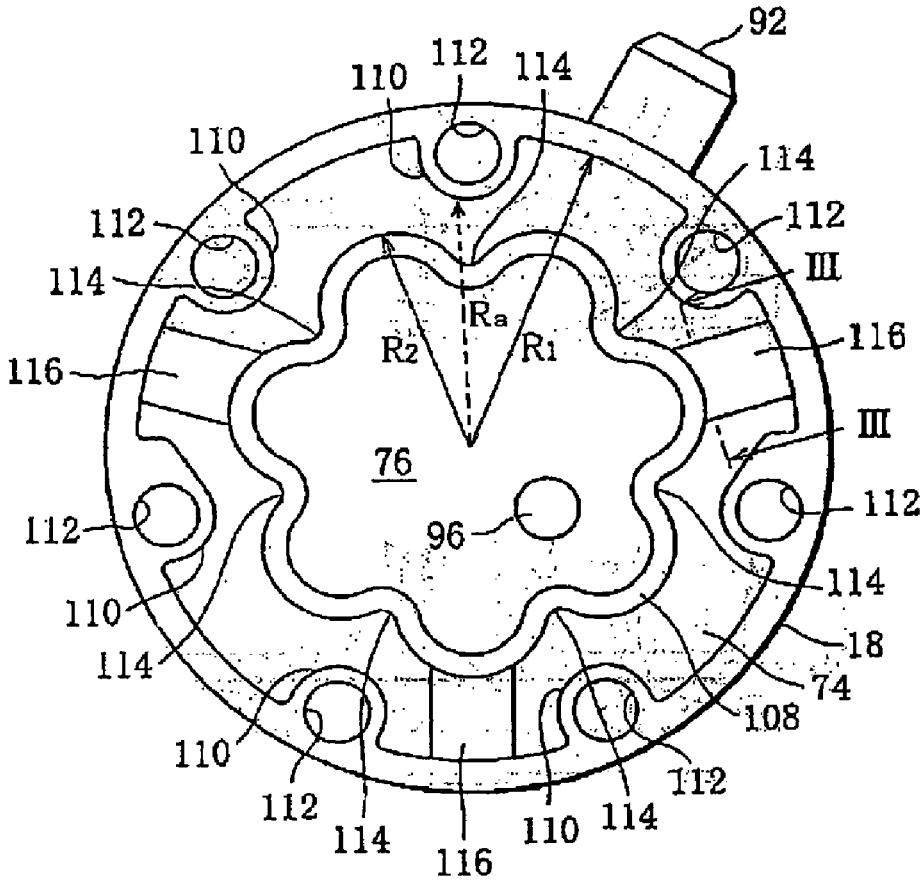
FIG. 2 is a view showing the interior of a cylinders head of the compressor shown in FIG. 1.

As is clear from FIG. 2, an annular partition wall 108 is formed inside the cylinder head 18 to separate the annular suction chamber 74 and the discharge chamber 76 from each other. A plurality of bulges 110 protrude from the inner peripheral surface of the cylinder head 18 at regular intervals in the circumferential direction thereof and insertion holes 112 for the aforementioned connecting bolts 66 are formed through the respective bulges 110. The partition wall 108 has dimples 114 corresponding in position to the respective bulges 110. The dimples 114 serve to make the width of the annular suction chamber 74 substantially uniform along the circumference thereof.

Figure 3:
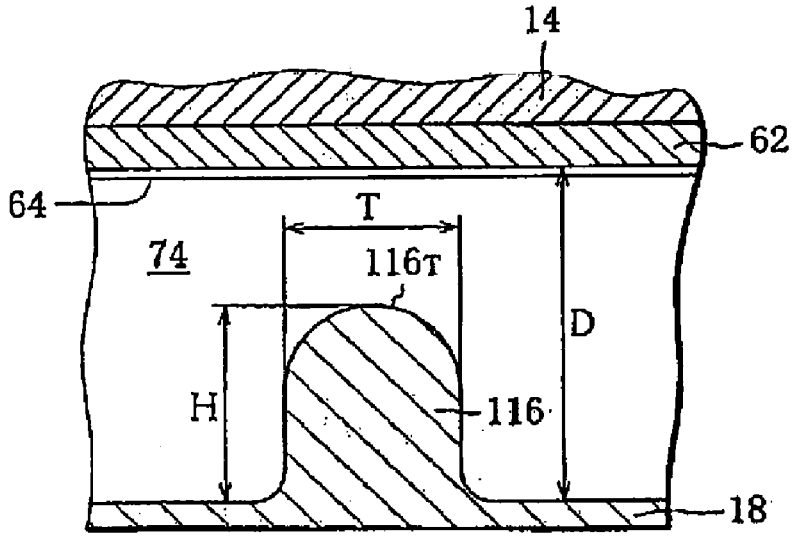
FIG. 3 is a sectional view taken along line III-III in FIG. 2.

Also, a plurality of cross walls 116 as throat elements are formed in the suction chamber 74. The cross walls 116 are spaced from each other in the circumferential direction of the suction chamber 74 and extend from the inner peripheral surface of the cylinder head 18 to the outer peripheral surface of the partition wall 108 so as to cross the suction chamber 74. More specifically, each cross wall 116 protrudes from the inner end face of the cylinder head 18 facing the valve plate 62, as shown in FIG. 3, and the height H of the protrusion is approximately half the depth D of the cylinder head 18 (i.e., the distance between the inner end face of the cylinder head 18 and the valve plate 62). The thickness T of the cross wall 116 along the circumferential direction of the suction chamber 74 is also approximately half the depth D of the cylinder head 18. Further, the cross wall 116 has a top $\mathbf{116}_T$ having a semicircular shape as viewed in cross section.

In this embodiment, the cylinder head 18 is provided with three cross walls 116, as clearly shown in FIG. 2. The cross walls 116 are arranged at regular intervals in the circumferential direction of the suction chamber 74, and the suction port 92 is arranged not in the middle position between two cross walls 116 but at a location shifted from the middle position toward one of the two cross walls 116, as viewed in the circumferential direction of the suction chamber 74.

Specifically, the annular suction chamber 74 has an average radius $R_A$ of about 50 mm and a depth D of about 30 mm. Provided the radius of the inner periphery of the cylinder head 18 is $R_1$ and the radius of the outer periphery of the partition wall 108 is $R_2$, the average radius $R_A$ is given by the following equation:

$$R_A=(R_1+R_2)/2$$

In the compressor described above, when the swash plate 46 is rotated by the drive shaft 32, rotation of the swash plate 46 is converted to reciprocating motion of the pistons 40. As each piston 40 moves toward the crank chamber 24, the refrigerant in the suction chamber 74 is introduced into the compression chamber 58 through the suction valve 78. As the piston 40 moves toward the valve plate 62 thereafter, the refrigerant introduced into the compression chamber 58 is compressed. When the refrigerant pressure in the compression chamber 58 exceeds the valve closing pressure of the discharge valve 80, the high-pressure refrigerant is discharged from the compression chamber 58 to the discharge chamber 76 through the discharge valve 80.

The refrigerant in the discharge chamber 76 then circulates in the refrigerant path 2 of the refrigeration circuit and, after being used for cooling the vehicle compartment, returns to the suction chamber 74 of the compressor 4.

The displacement of the compressor 4 can be varied by adjusting the reciprocating stroke of the pistons 40, that is, the inclination angle of the swash plate 46, and the inclination angle is controlled by the pressure in the crank chamber 24. More specifically, when the solenoid valve 102 is open, part of the high-pressure refrigerant in the discharge chamber 76 is introduced into the crank chamber 24 through the connecting passage 100, thus increasing the pressure in the crank chamber 24. In this case, the inclination angle of the swash plate 46, that is, the reciprocating stroke of the pistons 40, decreases, so that the displacement decreases.

On the other hand, while the introduction of the refrigerant into the crank chamber 24 is stopped, the pressure in the crank chamber 24 is relieved into the lower-pressure suction chamber 74 through the communicating passage 104 provided with the orifice 106, so that the pressure in the crank chamber 24 gradually decreases. As a result, the reciprocating stroke of the pistons 40 (inclination angle of the swash plate 46) increases to increase the displacement.

Since the pistons 40 are spaced in the circumferential direction of the cylinder block 14, the reciprocations of the pistons 40 take place in turn with rotation of the swash plate 46. Namely, the refrigerant in the suction chamber 74 is introduced sequentially into the compression chambers 58 arranged in the circumferential direction of the cylinder block 14, and each time the refrigerant is introduced, the pressure in the suction chamber 74 temporarily drops, allowing the refrigerant to flow into the suction chamber 74 through the suction port 92. Accordingly, the pressure in the suction chamber 74 rises and falls each time the refrigerant is introduced into one of the compression chambers 58. Such pressure variation is propagated in the circumferential direction of the suction chamber 74, causing pressure pulsation in the suction chamber 74.

In the compressor of this embodiment, the suction chamber 74 in the cylinder head 18 has multiple cross walls 116 formed therein, and the cross walls 116 partially obstruct the pressure pulsation in the suction chamber 74 and reverse the propagating direction of the pressure pulsation. Accordingly, by arranging the cross walls 116 appropriately in the circumferential direction of the suction chamber 74, it is possible to effectively restrain, by means of the cross walls 116, the pressure pulsation from being notably amplified in a specific frequency range corresponding to the circumferential length of the suction chamber 74.

Figure 4:
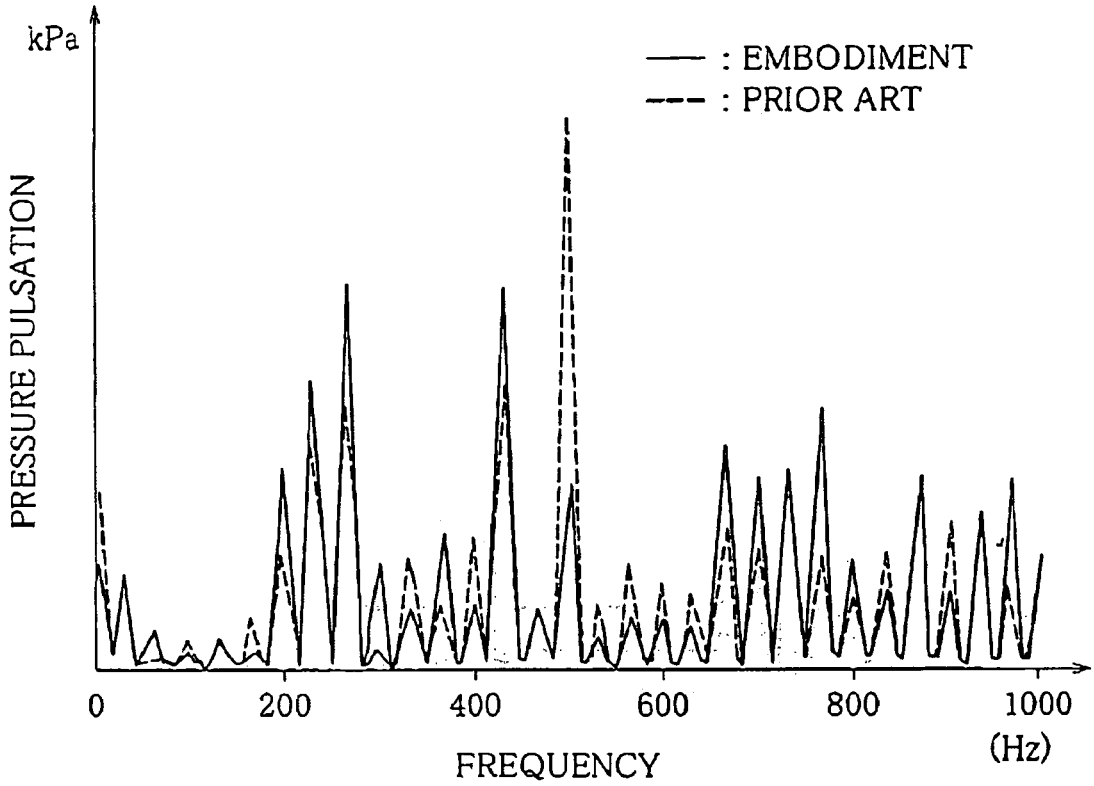
FIG. 4 is a graph showing frequency distribution of pressure pulsation produced in a suction chamber.

FIG. 4 clearly shows the pressure pulsation reducing effect achieved by the cross walls 116. In FIG. 4, the solid line indicates the frequency distribution of pressure pulsation produced in the suction chamber 74. During the measurement, the rotating speed of the compressor 4 was 2000 rpm and the pressure of the refrigerant discharged into the discharge chamber 76 was 0.9 MPa. The broken line in FIG. 4 indicates the frequency distribution of pressure pulsation observed in the case where a conventional compressor with no cross walls was driven under the same conditions.

As is clear from FIG. 4, the conventional compressor showed noticeable pressure pulsation in the specific frequency range around 500 Hz, while in the compressor according to the embodiment, the pressure pulsation in the specific frequency range could be effectively suppressed.

Accordingly, the compressor of this embodiment makes it unnecessary to insert a muffler in the suction pipe 94 or form an expansion chamber in the cylinder head 18 in order to reduce vibrations of and noise from the components in the refrigeration circuit, and thus the compressor need not be increased in size.

Since each cross wall 116 does not completely close up the suction chamber 74 and has the arcuate top $\mathbf{116}_T$, the propagation of pressure variation in the suction chamber 74 is never hindered to an undesirable extent. This means that the refrigerant is stably supplied to the suction chamber 74 each time the refrigerant is introduced into any of the compression chambers 58, and thus the refrigerant suction loss in the suction chamber 74 can be effectively suppressed.

The present invention is not limited to the embodiment described above and may be modified in various ways.

For example, the number of the cross walls 116 is not limited to three and may be two or more than three. Also, it is not essential that the intervals between the cross walls 116 be equal in the circumferential direction of the suction chamber 74.

Figure 5:
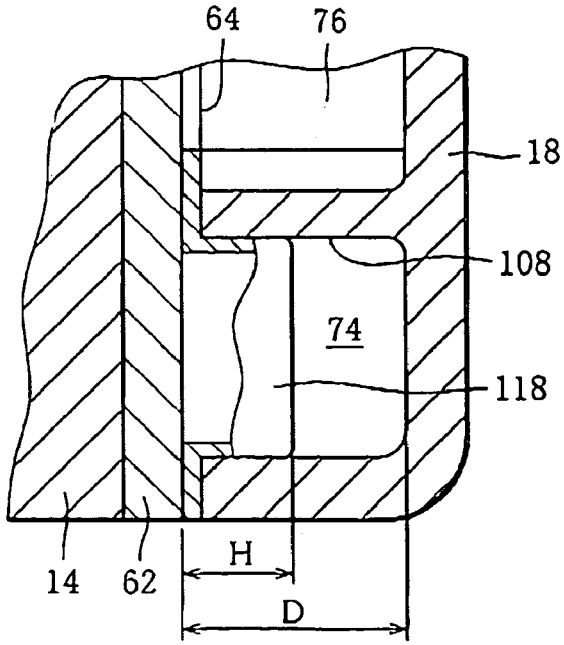
FIG. 5 is a view showing a modified cross wall.

Further, instead of the aforementioned cross walls 116, cross walls 118 shown in FIG. 5 may be used. The cross walls 118 are formed integrally with the gasket 62 as a one-piece body. Like the cross walls 116, the cross walls 118 partially decrease the depth D of the suction chamber 74 and can partially obstruct the propagation of pressure pulsation as viewed in the circumferential direction of the suction chamber 74.

The cross walls 116 and 118 both reduce the depth D of the suction chamber 74 to partially obstruct the propagation of pressure pulsation, but the propagation of pressure pulsation may also be partially blocked by partially decreasing the width of the suction chamber 74 as viewed in the circumferential direction of the suction chamber 74.

Figure 6:
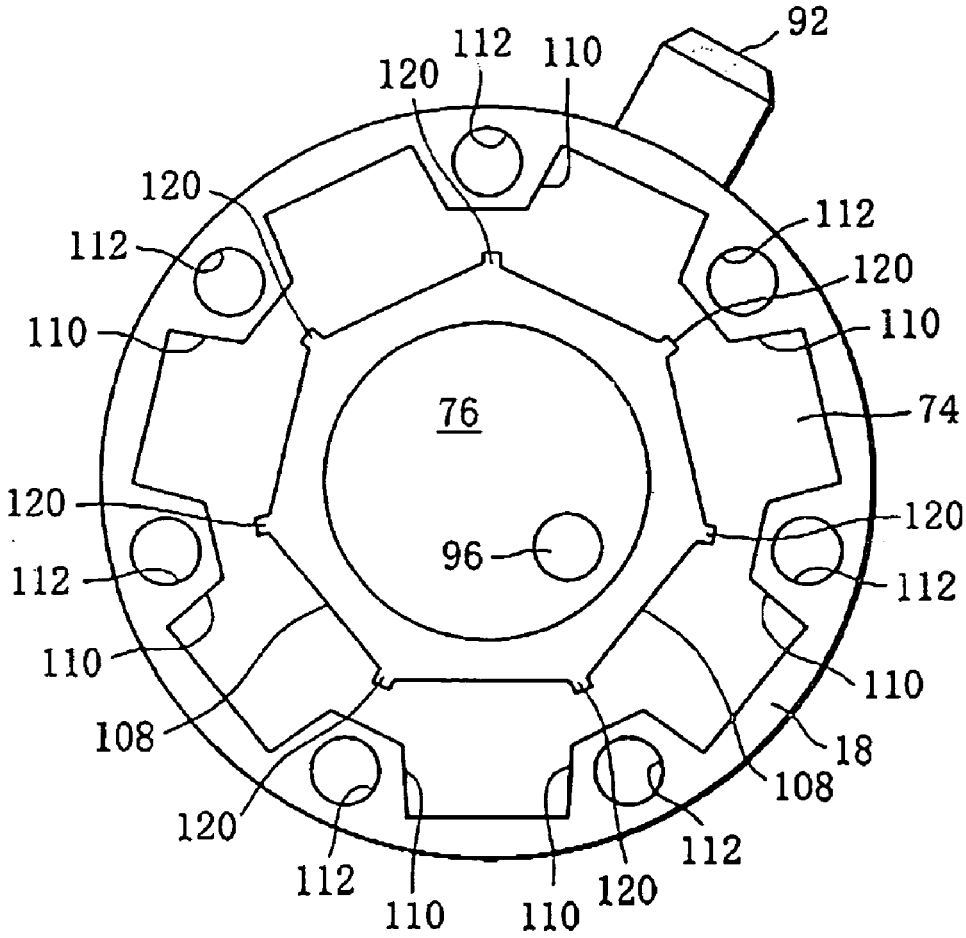
FIG. 6 is a view showing the interior of a modified cylinder head.

Specifically, as shown in FIG. 6, the cylinder head 18 has a plurality of protuberances 120 protruding from the outer peripheral surface of the partition wall 108. The protuberances 120 are arranged so as to correspond in position to the bulges 110 of the cylinder head 18 such that the distance between each protuberance 120 and the bulge 110 associated therewith is smaller than the distance between the inner peripheral surface of the cylinder head 18 and the outer peripheral surface of the partition wall 108. Namely, the protuberances 120 and the bulges 110 cooperatively constitute a plurality of gates for partially obstructing the propagation of pressure pulsation in the suction chamber 74.

Further, as clearly shown in FIG. 6, a region of the suction chamber 74 located between the gates preferably forms a passage with a nearly rectangular parallelepipedic shape extending in the circumferential direction of the suction chamber 74. In this case, the aforementioned refrigerant suction loss can be effectively suppressed.

As will be clear from the above description, a plurality of cross walls 116 or 118 or gates have only to be formed, and the arrangement and number of the cross walls or gates to be formed are suitably determined in accordance with the specific frequency range in which amplification of pressure pulsation is to be suppressed.

What is claimed is:

1. A multi-cylinder reciprocating compressor comprising:

a cylinder block having a plurality of cylinder bores;

a plurality of pistons received in the respective cylinder bores, for defining compression chambers in the respective cylinder bores;

a cylinder head arranged adjacent to said cylinder block and defining therein a suction chamber and a discharge chamber both capable of communicating with the compression chambers, the suction chamber having an annular shape surrounding the discharge chamber and having a suction port for introducing working fluid into the suction chamber;

a drive mechanism for sequentially reciprocating said pistons, to perform an introduction process for introducing the working fluid into each of the compression chambers from the suction chamber and a compression/discharge process for compressing the working fluid introduced into said each compression chamber and discharging the compressed working fluid from said each compression chamber to the discharge chamber;

a valve plate interposed, along with a gasket, between said cylinder block and said cylinder head, said valve plate having suction holes associated with the respective compression chambers for connecting the respective compression chambers and the suction chamber to each other and discharge holes associated with the respective compression chambers for connecting the respective compression chambers and the discharge chamber to each other, a plurality of first throat elements located in the suction chamber, for reducing cross-sectional flow area of the suction chamber at a plurality of positions as viewed in a circumferential direction of said cylinder head, wherein each of said plurality of throat elements comprises a cross wall, wherein each of said cross walls is formed integrally with the gasket as a one-piece body, and extends in a direction away from said cylinder block toward an end face of the suction chamber; and a plurality of second throat elements disposed in the suction chamber, for reducing the cross-sectional flow area of the suction chamber in a width direction thereof along a radial direction of said cylinder head, wherein said cylinder head includes an annular partition wall separating the suction chamber and the discharge chamber from each other, and each of said second throat elements comprises protuberances protruding from the partition wall and an inner peripheral surface of said cylinder head, respectively, in a radial direction of said cylinder head.

2. The compressor according to claim 1, wherein each of said cross walls reduces the cross-sectional flow area of the suction chamber in a depth direction thereof along an axial direction of said cylinder head.

3. The compressor according to claim 2, wherein each of said cross walls has a height along the axial direction of said cylinder head, the height being approximately half the depth of the suction chamber.

4. The compressor according to claim 2, wherein each of said cross walls has a thickness along the circumferential direction of said cylinder head, the thickness being approximately half the depth of the suction chamber.

5. The compressor according to claim 2, wherein each of said cross walls has a top arcuately curved along a circumferential direction of the suction chamber.

6. The compressor according to claim 1, wherein regions of substantially rectangular suction chambers located between the protuberances as viewed in the circumferential direction of said cylinder head, the substantially rectangular suction chambers form a passage with a parallelepipedic shape.

* * * * *

UNITED STATES PATENT AND TRADEMARK OFFICE

CERTIFICATE OF CORRECTION

PATENT NO. : 7,607,900 B2
APPLICATION NO. : 10/937892
DATED : October 27, 2009
INVENTOR(S) : Ichikawa et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 708 days.

Signed and Sealed this

Twelfth Day of October, 2010

David J. Kappos

David J. Kappos
*Director of the United States Patent and Trademark Office*